US007878374B2

(12) United States Patent
Decottignies et al.

(10) Patent No.: US 7,878,374 B2
(45) Date of Patent: Feb. 1, 2011

(54) FLUID PRODUCT DISPENSER

(75) Inventors: Laurent Decottignies, Cergy (FR); Alain Behar, Sureshes (FR)

(73) Assignee: AirlessSystems, Charleval (FR)

( * ) Notice: Subject to any disclaimer, the term of this patent is extended or adjusted under 35 U.S.C. 154(b) by 789 days.

(21) Appl. No.: 10/550,086

(22) PCT Filed: Mar. 22, 2004

(86) PCT No.: PCT/FR2004/000692

§ 371 (c)(1),
(2), (4) Date: Jul. 27, 2006

(87) PCT Pub. No.: WO2004/085276

PCT Pub. Date: Oct. 7, 2004

(65) Prior Publication Data

US 2007/0102454 A1 May 10, 2007

(30) Foreign Application Priority Data

Mar. 24, 2003 (FR) ..... 03 03559

(51) Int. Cl.
*B65D 37/00* (2006.01)

(52) U.S. Cl. ..... 222/207; 222/213; 222/256; 222/491; 401/183

(58) Field of Classification Search ..... 222/207, 222/256, 491, 209, 212, 213, 215, 494; 401/183, 401/184, 186
See application file for complete search history.

(56) References Cited

U.S. PATENT DOCUMENTS 3,107,035 A * 10/1963 Bertram ..... 222/213
3,141,580 A * 7/1964 Rogers ..... 222/213
3,756,460 A 9/1973 Hill
3,794,223 A 2/1974 Patel
4,699,300 A * 10/1987 Blake ..... 222/494
4,776,495 A * 10/1988 Vignot ..... 222/207
5,169,039 A * 12/1992 Kay et al. ..... 222/509
5,190,190 A 3/1993 Fudalla
5,238,156 A * 8/1993 Andris ..... 222/207
5,271,513 A 12/1993 Crosnier et al.
5,439,146 A * 8/1995 Niss ..... 222/207
5,544,789 A * 8/1996 Gillingham ..... 222/207
5,601,212 A * 2/1997 Lee ..... 222/207
6,983,865 B2 * 1/2006 Cabarroque et al. .... 222/153.13

FOREIGN PATENT DOCUMENTS

DE 354 715 C 6/1922

* cited by examiner

*Primary Examiner*—Kevin P Shaver
*Assistant Examiner*—Jonathan Wood
(74) *Attorney, Agent, or Firm*—Sughrue Mion, PLLC

(57) ABSTRACT

A fluid dispenser comprising: a fluid reservoir (10) serving to contain fluid; and a dispenser head (2) mounted on the reservoir (10) to take fluid from the reservoir, said head (2) defining a dispensing chamber (26) communicating with the reservoir via an inlet valve (25, 215) and communicating with the outside at a dispensing orifice via an outlet valve (237, 222); said dispenser being characterized in that the chamber (26) comprises at least one elastically deformable actuating wall (231) that is depressed in order to generate a pressure inside the chamber that is high enough to close the inlet valve and to open the outlet valve.

14 Claims, 5 Drawing Sheets

FLUID PRODUCT DISPENSER

BACKGROUND OF THE INVENTION (1) Field of the Invention

The present invention relates to a fluid dispenser comprising a fluid reservoir, and a dispenser head mounted on or formed on the reservoir and for taking fluid from the reservoir. The head includes a dispensing chamber communicating with the reservoir via an inlet valve and communicating with the outside of the dispenser via an outlet valve. Dispensers of this type are in frequent use in the fields of perfumes, cosmetics, or indeed pharmaceuticals for packaging and dispensing various fluids, liquids, or powders.

(2) Description of Related Art

A conventional dispenser head for a conventional fluid dispenser consists of a pump forming a pump chamber provided with an inlet valve and with an outlet valve. The pump chamber also has a piston mounted to slide back and forth for selectively reducing the volume of the dispensing chamber. In general, the piston is mounted on an actuating rod capped by a pusher that can be depressed by means of one or more fingers of the hand in order to push the actuating rod and thus the piston into the dispensing chamber so as to reduce the volume thereof. The piston sliding results in the pressure inside the chamber increasing so as to close the inlet valve and so as to open the outlet valve, so that a passageway is opened for the fluid under pressure which can then be driven through the actuating rod to a nozzle that is advantageously formed in the pusher. It is also possible to drive the fluid at the outlet of the pump chamber towards a stationary dispensing orifice that is independent of the pusher.

Furthermore, also in the prior art, another type of fluid dispenser exists that does not have a pump and that is actuated by squeezing the reservoir. That results in the pressure inside the reservoir increasing so that a portion of the fluid stored in the reservoir is driven through a dispenser head that can optionally incorporate an outlet valve.

BRIEF SUMMARY OF THE INVENTION

An object of the present invention is to define another type of fluid dispenser that uses neither a piston pump nor a squeezable reservoir. Another object of the invention is to define a dispenser that can dispense with good precision. Another object of the invention is to define a dispenser that enables the fluid dispensed to be applied with precision as soon as it leaves the dispenser. It should be possible for the dispenser to be grasped conveniently and for it to be manipulated with precision.

To these ends, the present invention proposes a fluid dispenser comprising: a fluid reservoir serving to contain fluid; and a dispenser head mounted on the reservoir to take fluid from the reservoir, said head defining a dispensing chamber communicating with the reservoir via an inlet valve and communicating with the outside at a dispensing orifice via an outlet valve; said dispenser being characterized in that the chamber comprises at least one elastically deformable actuating wall that is depressed in order to generate a pressure inside the chamber that is high enough to close the inlet valve and to open the outlet valve. Thus, the dispenser can be considered as a kind of combination between a conventional pump and a squeezable reservoir in that the dispensing chamber can be likened to a pump chamber but with a portion of the pump chamber being elastically deformable. Advantageously, the actuating wall is formed by a sleeve that is at least locally flexible and that internally defines a portion of the dispensing chamber. Thus, the actuating wall extends around the entire dispenser head so that the fluid dispenser can be grasped and actuated regardless of its angular position relative to the hand of the user. Since the sleeve is substantially cylindrical or at least tubular, the actuating wall is also not situated at an end of the dispenser, as it is in a conventional pump pusher, but rather it is situated peripherally or laterally.

According to another characteristic of the invention, the head has a top opposite from the reservoir, the dispensing orifice being placed substantially at the top of the head. Preferably, the dispensing orifice is placed in a manner such that it is centered axially relative to the axis of symmetry of the dispenser. Advantageously, the outlet valve forms the dispensing orifice from which the dispensed fluid can be collected. Thus, the outlet valve simultaneously forms a seal that prevents a portion of the fluid from coming into contact with air. All or almost all of the fluid can be taken from the dispensing orifice so that no fluid or almost no fluid remains on the dispenser and in contact with air.

In another aspect of the invention, the sleeve has a stationary end forming anchor means and an opposite end forming a flexible lip in leaktight abutment against a seat, the lip and the seat together forming the outlet valve. The sleeve thus has two functions, namely acting as an actuating wall and acting as a moving member for the outlet valve.

In another aspect of the invention, the head has a body forming a ring serving to co-operate with the reservoir for fastening the head to the reservoir, said body forming an inlet valve seat.

According to another characteristic, the head further has a tube having a fastening end and an opposite end forming an outlet valve seat, the sleeve extending around the tube. Advantageously, the tube defines an internal volume in which the inlet valve is received, the internal volume communicating with a peripheral volume that extends around the tube inside the sleeve via at least one through opening, the dispensing chamber including the internal volume and the external volume. Preferably, the tube is fastened to the body via its fastening end, the sleeve being fastened to the tube and to the body via its anchor means.

In another aspect of the invention, the reservoir is "airless", i.e. it does not have any air intake. Advantageously, the reservoir is elongate and is preferably in the form of a fine tube. When the tube is of circular cross-section, it is advantageous for the diameter of the tube to be considerably smaller than its height.

According to another characteristic of the invention, the sleeve is surrounded by a substantially rigid sheath that defines at least one window giving access to the actuating wall. In a variant, or in addition, the sleeve is provided with a cap preventing access to the actuating wall. Advantageously, the cap is mounted to turn on the rigid sheath and is provided with at least one opening serving to come into register with said at least one window in a manner such as to enable the actuating wall to be accessed through a window and through an opening, with the window and the opening being mutually in register. In a variant, the cap has a collar in contact with the sleeve.

Preferably, the dispenser has the general shape of a pen that can be grasped in the hand in the manner of a pen, so that at least one finger of the hand is placed on the actuating wall with the dispensing orifice disposed at the tip of the pen. The dispenser of the invention can then be manipulated in the manner of a conventional pen, except that that portion of the pen on which the finger(s) of the hand rest(s) constitutes the actuating wall on which the user can press in order to dispense fluid. The elongate reservoir can be placed in the hand between the thumb and the index finger in the manner of the ink reservoir of a pen. By means of this ergonomic pen-shaped configuration, the dispenser of the invention can be manipulated easily and with precision.

BRIEF DESCRIPTION OF THE DRAWINGS

The invention is described more fully below with reference to the accompanying drawings which show a non-limiting embodiment of the invention.

In the figures.

DETAILED DESCRIPTION OF THE PREFERRED EMBODIMENTS

Figure 1:
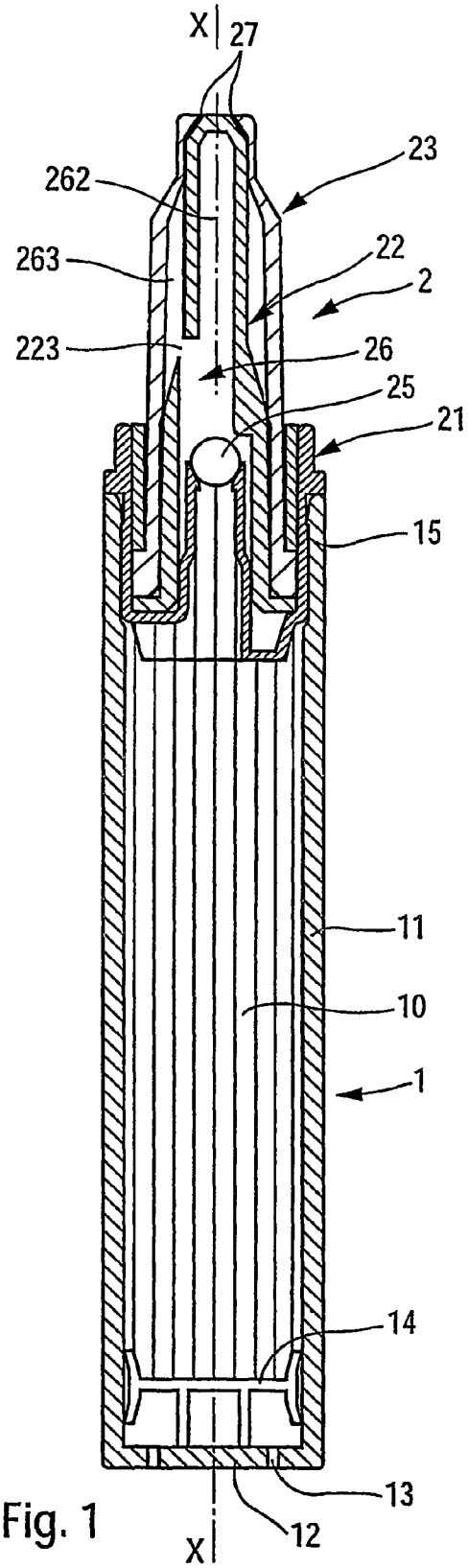
FIG. 1 is a vertical section view through a fluid dispenser of the invention in the assembled state.
Figure 2:
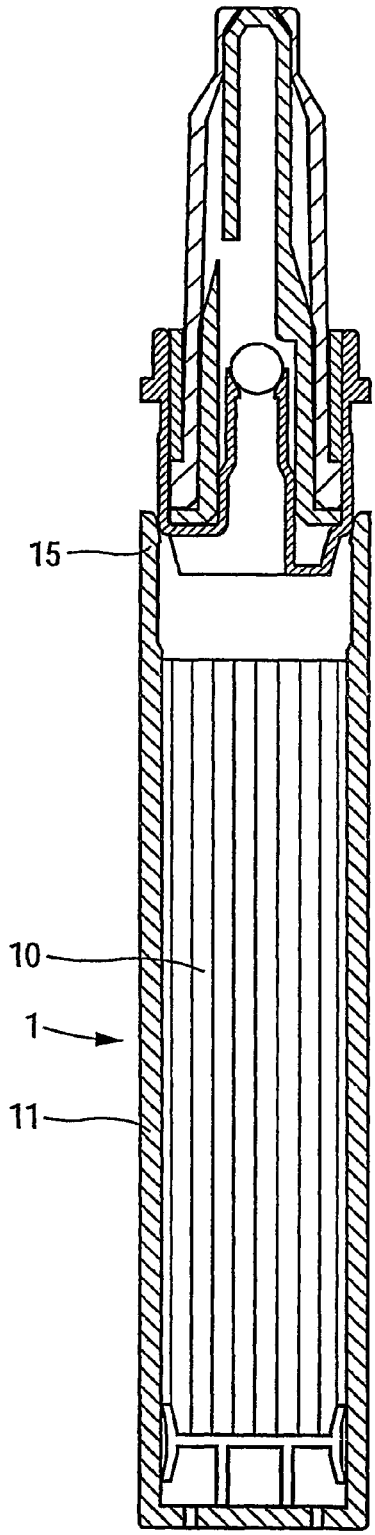
FIG. 2 is a view similar to FIG. 1 during assembly.

With reference to FIG. 1, it can immediately be seen that the dispenser of the invention has a very elongate shape, and has an axis X of revolution or of circular symmetry X that extends longitudinally and vertically when the dispenser is positioned upright, as it is in FIG. 1. The symmetry is not quite total as is explained below.

The dispenser of the invention comprises two main component elements, namely a reservoir 1 and a dispenser head 2. In this example, the dispenser head 2 is mounted on the reservoir 1. However, it is possible to imagine embodiments in which a portion of the dispenser head 2 or even the entire dispenser head 2 is formed integrally with a portion of the fluid reservoir 1 or with the entire fluid reservoir 1.

The fluid reservoir 1 is preferably highly elongate in shape in the manner of a fine tube. However, other shapes can also be imagined. The elongate shape is preferred for reasons given below. The fluid reservoir 1 comprises a drum 11 which, in this example, is substantially cylindrical in shape. Indeed, an exactly cylindrical shape is preferred. The drum 11 has a top end 15 which defines an opening inside the drum 11. The drum 11 also has a bottom 12 which closes off the drum at its bottom end. However, holes 13 are provided in the bottom 12 for making it possible for the inside of the drum and the outside of the drum to communicate with each other. The drum 11 is also provided with a scraper or follower piston 14 which is initially positioned in the vicinity of or even in contact with the bottom 12. Indeed, the bottom 12 is not essential and can even be omitted without modifying the function of the reservoir 1. The drum 11 and the follower piston 14 co-operate to form the working volume 10 of the reservoir 1. The follower piston 14 is adapted to move by sliding in leaktight manner inside the drum 11. Therefore, it is preferable for the drum 11, at least at its inside wall, to be exactly cylindrical. In fact, the follower piston 14 constitutes the bottom of the working volume 10 of the reservoir 1.

In place of the follower piston system, it also possible, to form the reservoir 1 by using a system of flexible pouches comprising a freely deformable pouch whose inside serves as a working volume for storing fluid. The flexible pouch system can further comprise a rigid outer shell enclosing the flexible pouch. For example, the drum 11, together with its bottom 12, can constitute a rigid outer shell inside which a freely deformable flexible pouch can be positioned. Naturally, the flexible pouch is provided with an opening fastened to the dispenser head 2.

Figure 3:
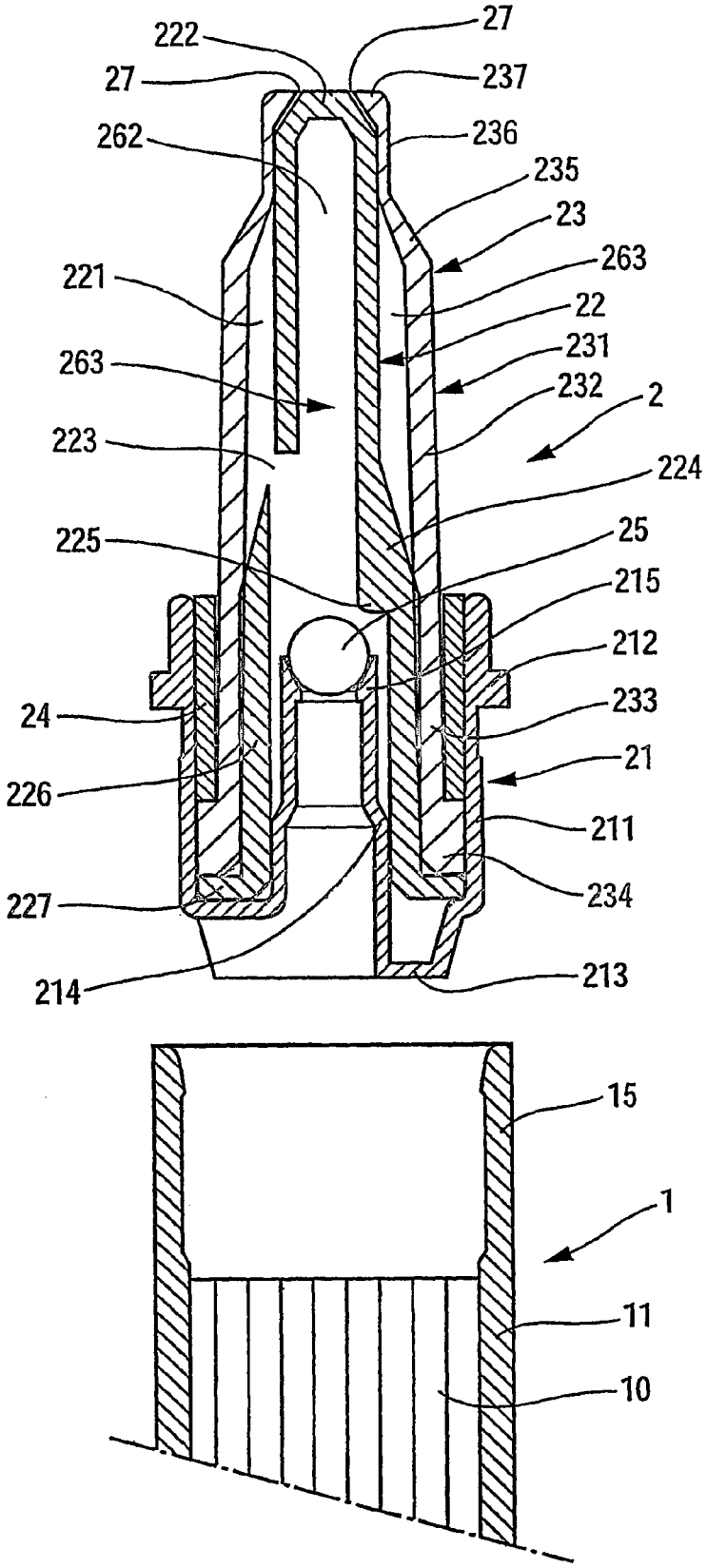
FIG. 3 is an enlarged exploded view of the top portion of the dispenser of FIGS. 1 and 2.

The dispenser head 2 can be seen more clearly in FIG. 3. In this non-limiting embodiment, the head 2 comprises a plurality of component elements, namely a body 21, a tube 22, and a sleeve 23. The body 21 forms a fastening ring 211 serving to be force fitted into or force snap-fastened into the drum 11 at its top end 15 which therefore forms a reservoir neck. The inside wall of the neck 15 can have a profile shaped suitably for enabling the ring 211 to be fastened securely into the neck. Similarly, the outside wall of the ring 211 can be provided with complementary graspable profiles. The ring 211 is thus pushed into the drum 11 over a certain depth. In order to limit the depth to which the ring is inserted into the drum 11, the body 21 forms an abutment collar 212 which projects radially outwards. The collar 212 is situated above the ring 211 so that it comes into abutment against the top end edge of the neck 15 as can be seen in FIG. 1. At its bottom end, the ring 211 is extended by an annular flange 213 which connects internally to a duct 214 forming a free top end defining a seat for an inlet valve seat 215. The ring 211 and the duct 214 extend substantially concentrically so that, together, they form an annular recess defined externally by the ring 211, internally by the duct 214, and downwards by the annular flange 213. The annular recess is thus open upwards. Said annular recess serves to receive and to fasten the tube 22 and the sleeve 23 as explained below. The valve seat 215 co-operates in leaktight manner with a moving inlet valve member which, in this example, is in the form of a spherical ball 25. It is also possible to provide a moving inlet valve member that has a shape other than the conventional spherical shape. A moving member made of a plastics material is possible and even preferable in certain cases. It is easy to understand from the figures that the duct 214 communicates directly with or is even an integral part of the working volume 10 of the reservoir 1, as can be seen in FIG. 1. The duct 214 forms an inlet for enabling the fluid to enter the dispenser head 2.

In a variant (not shown), the body 21 can be made integrally with the drum 11. In which case, the drum 11 does not have a bottom 12 so that the working volume 10 can be filled through the open bottom of the drum 11. Filling can then be performed while the dispenser head 2 is already in place on the reservoir 1.

Like the body 21, the tube 22 is preferably made of a rigid plastics material. The tube 22 is generally elongate and hollow in shape. The tube is open at its bottom end and it is closed at its top end. Overall, the tube can be subdivided into a bottom base 226 forming the open bottom end and a top end-piece 221 forming the closed top end 222. The open bottom end 227 forms fastening means for fastening the tube to the ring 21 and more precisely into the annular recess formed inside the ring 211 around the duct 214. For example, the bottom end 227 can be formed with a foot in the form of a flange that extends radially outwards. This flange can be force inserted into the annular recess so as to come into contact both with the ring 211 and with the duct 214. The base 226 extends upwards from the bottom end 227 in substantially cylindrical manner. The base 226 surrounds the duct 214 and the ball 25. At a very small distance above the ball 25, the base 26 forms one or more inwardly extending shoulders 225 that hold the ball 25 captive in a delimited space. Thus, the ball 25 is always constrained to be re-positioned on its seat 215. Starting from said shoulders 225, the base 226 forms a transition portion 224 for connecting to the end-piece 221. At said transition portion 224, the base forms one or more through openings 223 that put the inside of the tube 262 into communication with the outside of the tube. Beyond said openings, the end-piece 221 extends substantially cylindrically to its end 222 which closes off the end-piece with a substantially rounded and partially spherical or semi-spherical shape. The inside volume formed by the tube 22 is also defined by the duct 214 and the ball 25 forms a first portion 262 of a dispensing chamber.

The sleeve 23 can be made of an elastically deformable material such as an elastomer thermoplastic. The sleeve is generally tubular in shape and can be approximately cylindrical, but with segments that are not cylindrical. The term "sleeve" indicates that this element surrounds the tube while being open at at least one of its ends, and in this example at both ends.

The sleeve 23 is provided with an anchor heel 234 engaged inside the neck 21 immediately under the flange 227 of the tube 22 and around the base 226. Above said anchor heel 234, the sleeve forms a stable first segment 223 which is held stationary so that it is prevented from turning about the base 226 by means of a ferrule 24 engaged around the segment 233 inside the ring 211. Said ferrule 228 holds the heel 234 stationary and also holds the segment 233 of the sleeve 23 stationary inside the body 21. Beyond said stable first segment 233, the sleeve forms a second segment 232 that is at least locally elastically deformable and that extends around the end-piece 221 of the tube 22 without being in contact therewith. An annular volume or space remains inside the sleeve around the end-piece 221. This internal volume constitutes a second portion 223 of a dispensing chamber. The volume 263 communicates with the volume 262 via openings 223. The volumes 262 and 263 together form the working volume of the dispensing chamber. The segment 232 forms one or more actuating walls 231. The wall can extend over the entire periphery and/or over the entire height of the segment 232. A plurality of walls can be present, separated by rigid or flexible zones.

Beyond the elastically deformable segment 232, the sleeve forms a frustoconical segment 235 that is extended by a casing 236 that is in contact with the top portion of the end-piece 221. The casing 236 forms a central opening defined by an elastically deformable annular lip 237. Said lip 237 comes into leaktight pressing contact against the top end or "top" 222 of the end-piece 221. When the pressure inside the chamber 262, 263 increases, the ball 25 is pressed against its seat 215, thereby preventing the fluid stored in the chamber 262, 263 from being driven back towards the reservoir 10. The pressure then increases inside the chamber until the fluid under pressure forces its way between the casing 236 and the top end of the tube 21. The fluid under pressure then reaches the lip 237 that it deforms so as to lift it off its seat 222. A dispensing orifice 27 is then formed between the lip 37 and the top 222. In this example, said dispensing orifice is annular in shape because the lip 237 is annular and comes into annular contact with the top 222. The fluid under pressure that exits via the orifice 27 can then accumulate on the top 222 and on the lip 237. The user can then collect the fluid, e.g. by means of a finger or else can apply it directly to a desired application surface, such as the skin, for example, a mucous membrane, an eye, a fingernail or a toenail, hair, eyebrows, eyelashes, etc. Naturally, as soon as the pressure falls again inside the chamber 262, 263, the lip 237 is pressed again in leaktight manner against its seat 222. The chamber is then isolated from the outside again. However, suction is generated inside the chamber as the pressure on the wall 231 of the sleeve 23 is released. This suction causes the ball 25 to lift off its seat 215, thereby forming an inlet passageway for the fluid coming from the reservoir 10. The fluid is sucked into the chamber by the suction. The chamber can then fill with fluid again.

It can be seen that the top portion of the head formed by the top 22, by the casing 236, and by the lip 237 has a configuration similar to the configuration of the tip of a ball-point pen. In a ball-point pen, a ball is urged into leaktight abutment against an annular seat. When said ball comes into contact with a writing surface, it is pushed away from its seat, thereby opening up a passageway through which ink can flow from a reservoir in which it is stored. The tip of a ball-point pen is preferably exactly centered on the longitudinal axis of symmetry of the pen. Thus, the pen can be held in the hand regardless of its angular position around its axis of symmetry. The same applies to the dispenser of the present invention, in which dispenser the dispensing orifice 27 is preferably exactly centered on the axis of symmetry X of the dispenser. An offset position in which it is offset relative to said axis can however be considered. In addition, it is also possible to observe that the deformable segment 231 of the sleeve 23 extends over the entire periphery of the head 2 and over a certain height. Thus, it is guaranteed that the user will position the fingers on the deformable segment 231 regardless of the angular position of the dispenser relative to its axis of symmetry X. The deformable segment 231 of the sleeve is positioned in a manner such that the user can grasp the dispenser in the same way as a conventional pen is grasped. It is even possible to write with the dispenser of the invention. The deformable segment 231 of the sleeve 23 can be deformed by means of one, two, or preferably three fingers of the same hand. Very high manipulation precision is thus obtained, enabling very precise and controlled dispensing to be achieved.

It should be noted that only the chamber portion 263 is subjected to a variation in volume, while the chamber portion 262 has a constant volume. If desired, a portion or even all of the volume of the chamber 262 can be filled so as to reduce the dead volume of the dispensing chamber. The chamber is then mainly constituted by the portion 263.

It can also be observed that the highly elongate tubular shape of the drum 11 makes the dispenser look even more like a pen. The drum 11 can even rest in the hand between the index finger and the thumb when the user grasps the dispenser, in the manner of a conventional pen.

The principle of the invention also lies in the fact that a dispensing chamber is provided that has an elastically deformable actuating wall that is actuated laterally relative to the main axis of symmetry of the dispenser. The axial orifice further contributes to the ease with which the dispenser can be grasped and manipulated.

Figure 4:
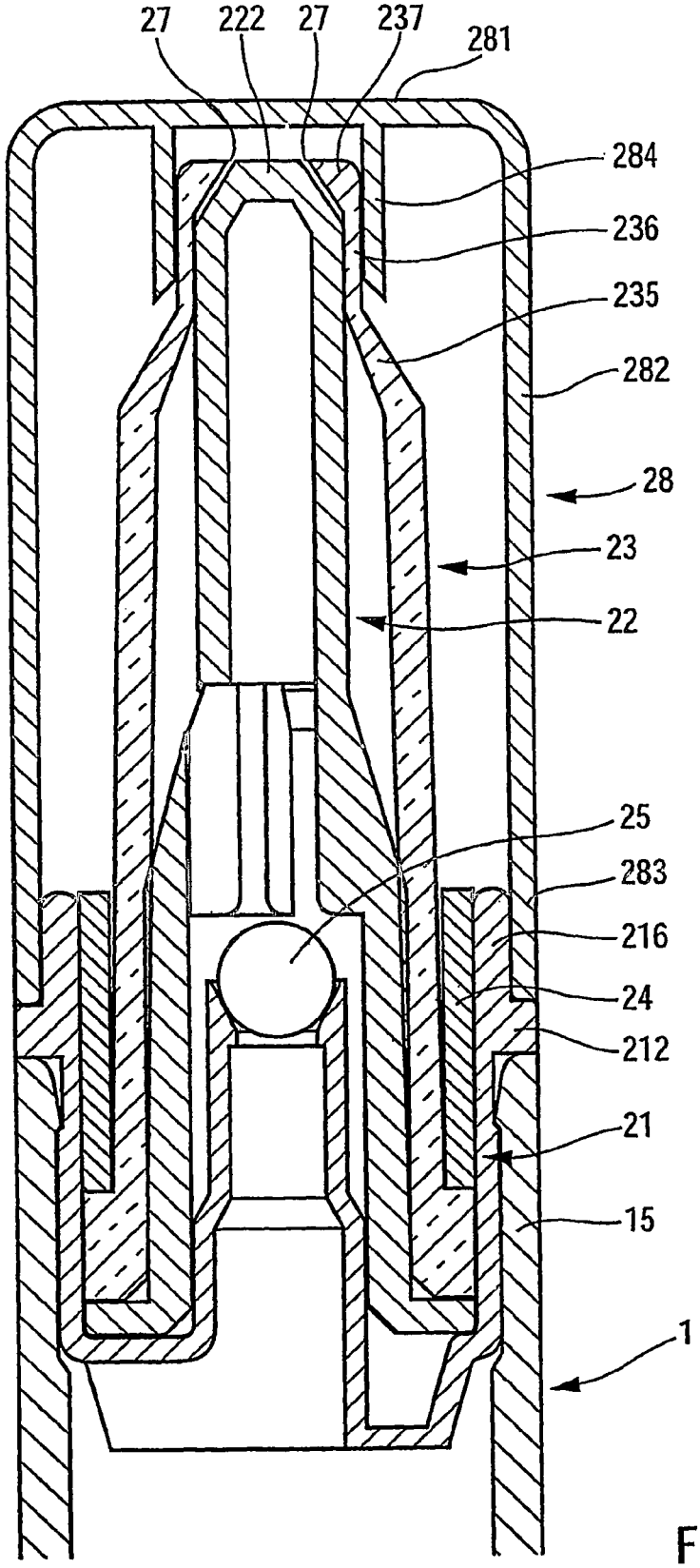
FIG. 4 is a section view through the top portion of the dispenser in a variant of the embodiment of FIGS. 1 and 3.

FIG. 4 shows the top portion of a dispenser in a variant in which a protective cap 28 is added that masks and protects the top portion of the dispenser head. The cap comprises a top wall 281 from which a peripheral skirt 282 extends that has a peripheral bottom end 283 engaged more or less tightly with the body 21. More precisely, the end 283 of the skirt 282 engages around an annular flange 216 formed above the collar 212. In addition, the bottom edge of the end 283 comes into abutment against the collar 212. The cap 28 can thus be put in place and removed at will. Its function is to protect the top portion of the dispenser and more particularly the outer portion of the sleeve 23. Advantageously, the cap 28 also forms a collar 284 which, in this example, extends from the bottom face of the top wall 281. Said collar 284, which is in the form of a cylindrical sheath, comes into engagement around the casing 236 and advantageously presses said casing 236 against the tube 22 so as to interrupt the fluid communication between the reservoir and the dispensing orifice 27. Thus, when the cap is in place on the head, it both protects the casing 223 and also prevents any fluid leakage. Naturally, such a cap 28 can be implemented with the preceding embodiment.

The embodiment of FIGS. 5 to 8 also implements a cap 25 which, more particularly, protects the actuating wall 231 formed by the sleeve 23. The cap 25 remains secured to the dispenser head and cannot be removed therefrom, unlike the cap 28 of the FIG. 4. The cap 25 is mounted in a manner that is entirely static or stationary, or, in a variant, the cap can be mounted to turn. The cap 25 includes a fastening band 251 engaged on the body 21. The fastening band 251 can be positioned in a manner similar to the bottom end 283 of the cap 28 of FIG. 4. Above the band 251, the cap forms an internal shoulder 252 which is then extended by a skirt 253. The skirt 253 extends around the sleeve 23 where it forms the actuating wall(s) 231. Above the skirt 253, the cap 25 forms a frustoconical segment 254. The frustoconical segment 254 can come into engagement with the sleeve 23. However, this is not shown in the figures. The skirt 253 is advantageously formed with one or more openings 255 which give access to the actuating wall(s) 231. Said openings 255 define the place where the user is obliged to position the finger in order to press on the actuating wall 231. For example, it is possible to provide one opening or two openings, as shown in the figures. Such a cap 25 can be mounted in a manner that prevents it from turning.

Advantageously, said cap 25 can be associated with a sheath 24' whose bottom portion forms a ferrule 241 engaged in the body 21 around the sleeve 23, in the manner of the ferrule 24 in the preceding embodiments.

Figure 5:
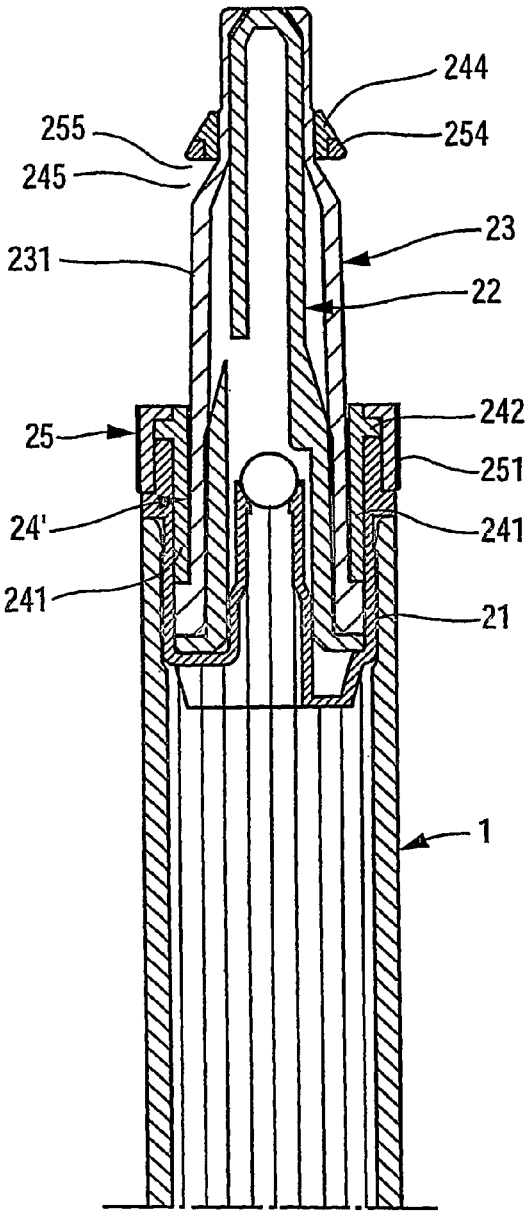
FIGS. 5 and 6 are views respectively in section and in elevation of a dispenser in another variant of the embodiment of FIGS. 1 to 3, in the open position.
Figure 6:
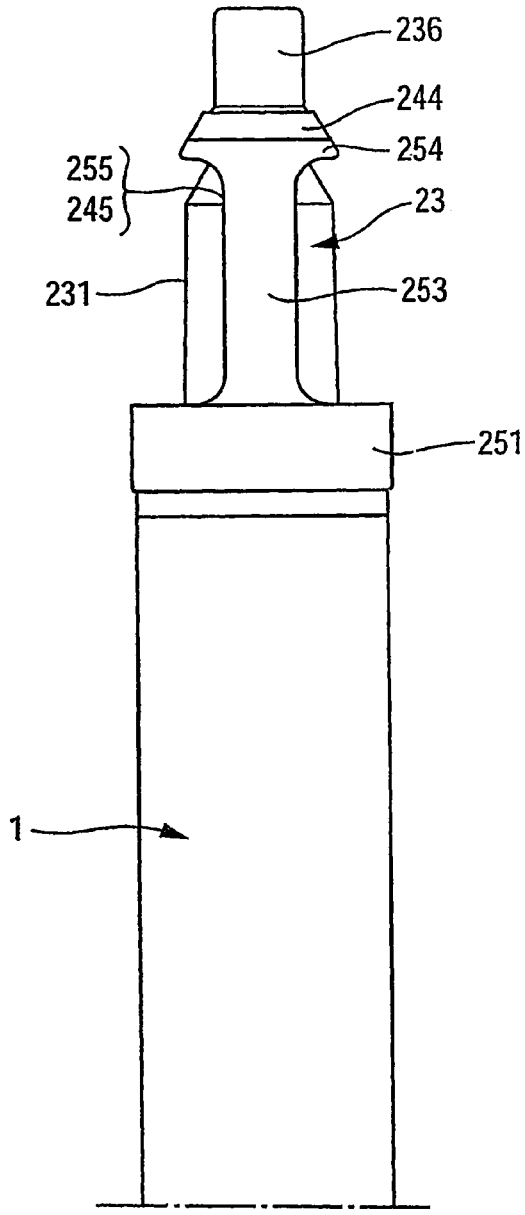
Figure 7:
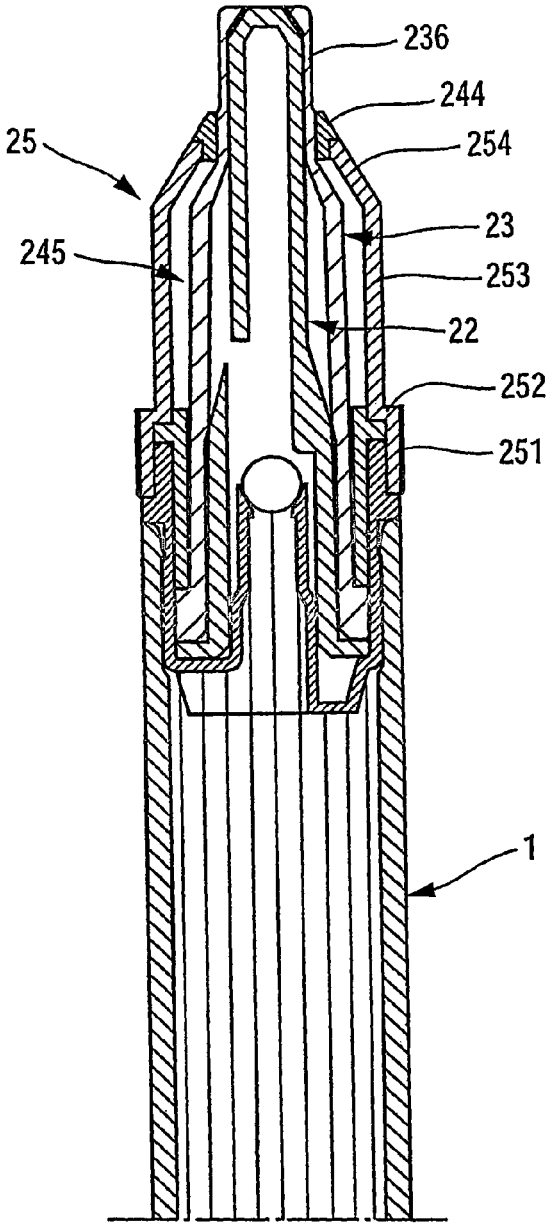
FIGS. 7 and 8 are views similar to FIGS. 5 and 6 in the closed position.
Figure 8:
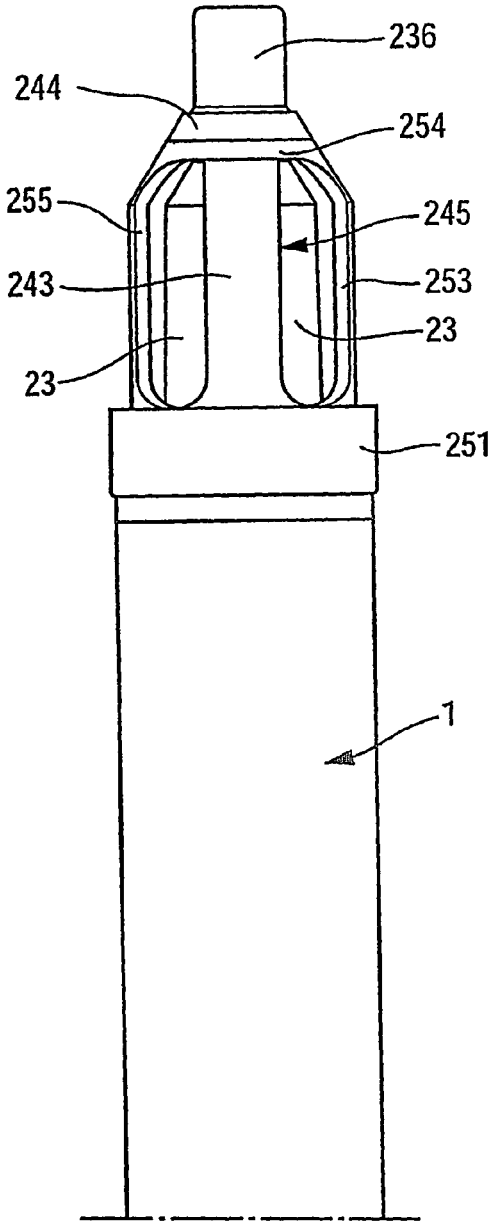

Above said bottom portion forming a ferrule 241, the sheath 24' forms a segment 243 in which one or more windows 245 are provided that give access to the sleeve 23 where said sleeve forms the actuating walls 231. The sheath 24' is situated inside the cap 25. The sheath is provided with a top collar 244 which comes into engagement around the sleeve 23. The top end of the frustoconical segment of the cap can come into engagement with the collar 244, optionally in turnable manner. The windows 245 of the sheath are situated at the same level as the openings 255 of the cap 25. The cap 25 is mounted to turn on the sheath 24', so that it is possible to bring the openings 255 and the windows 245 into register. Thus, the actuating wall 231 is accessible through an opening and through a window that are in register. This is shown in FIGS. 5 and 6. By turning the cap 25 relative to the sheath 24', it is also possible to offset the openings 255 relative to the windows 245. Thus, an uninterrupted portion of the segment 243 of the sheath 24 can be positioned at a window 255. The uninterrupted portion then prevents access to the actuating wall 231 through the opening 255. This is shown in FIGS. 7 and 8.

The sheath 24' defines the place where the user is obliged to apply a finger in order to depress the actuating wall 231. The turnable cap 25 also makes it possible to prevent access to the actuating wall 231.

When the cap 25 cannot turn, the sheath 24' can be omitted.

The invention claimed is:

1. A fluid dispenser comprising:

a fluid reservoir (10) serving to contain fluid; and a dispenser head (2) mounted on the reservoir (10) to take fluid from the reservoir, said head (2) defining a dispensing chamber (26) communicating with the reservoir via an inlet valve (25, 215) and communicating with the outside at a dispensing orifice via an outlet valve (237, 222);

wherein the chamber (26) is defined by at least one elastically deformable actuating wall (231) that is depressed radially inward in order to generate a pressure inside the chamber that is high enough to close the inlet valve and to open the outlet valve;

wherein the head (2) further comprises a rigid tube (22) having a fastening end (277) and an opposite end (222) forming an outlet valve seat; and wherein the actuating wall (231) is formed by a sleeve (23) extending around the tube (22).

2. A dispenser according to claim 1, in which the tube (22) defines an internal volume (262) in which the inlet valve (25, 215) is received, the internal volume communicating with a peripheral volume (263) that extends around the tube inside the sleeve (23) via at least one through opening (233), the dispensing chamber (26) including the internal volume (262) and the external volume (263).

3. A dispenser according to claim 1;

in which the tube (22) is fastened to a body (21) of the head via the fastening end (227), the sleeve (23) being fastened to the tube and to the body via anchor means (234).

4. A dispenser according to claim 1, in which the reservoir is airless, i.e. it does not have any air intake.

5. A dispenser according to claim 1, in which the reservoir (10) is elongate and is preferably in the form of a fine tube.

6. A dispenser according to claim 1, having the general shape of a pen that can be grasped in the hand in the manner of a pen, so that at least one finger of the hand is placed on the actuating wall (231) with the dispensing orifice disposed at the tip of the pen.

7. A dispenser according to claim 1, in which the sleeve (23) is surrounded by a substantially rigid sheath (24') that defines at least one window (245) giving access to the actuating wall (231).

8. A dispenser according to claim 1, in which the sleeve (23) is provided with a cap (25; 28) preventing access to the actuating wall.

9. A dispenser according to claim 7, wherein the sleeve (23) is provided with a cap (25; 28) preventing access to the actuating wall;

in which the cap (25) is mounted to turn on the rigid sheath (24') and is provided with at least one opening (255) serving to come into register with said at least one window (245) in a manner such as to enable the actuating wall to be accessed through a window and through an opening, with the window and the opening being mutually in register.

10. A dispenser according to claim 8, in which the cap (28) has a collar (284) in contact with the sleeve.

11. A fluid dispenser comprising:

a reservoir for containing fluid;

a tube mounted on the reservoir;

an inlet valve disposed inside of the tube for selectively drawing fluid from the reservoir; and an elastically deformable sleeve surrounding the tube, wherein the elastically deformable sleeve is deformable radially inward;

wherein a space between the tube and the elastically deformable sleeve defines a dispensing chamber; and wherein an outlet valve for the dispensing chamber is formed by the tube and the elastically deformable sleeve;

wherein the fluid dispenser is actuated by radially deforming the elastically deformable sleeve to increase the pressure in the dispensing chamber, thereby closing the inlet valve and opening the outlet valve.

12. The fluid dispenser according to claim 11, wherein the elastically deformable sleeve forms both an outlet for the dispenser chamber and a dispenser orifice from which the dispensed fluid can be collected.

13. The fluid dispenser according to claim 12, wherein the sleeve is flush with the tube in a longitudinal direction of the tube, such that the dispenser orifice is formed at a distal end of the tube.

14. The fluid dispenser according to claim 11, wherein the distance between a distal end of the tube and the fluid reservoir remains constant during actuation of the fluid dispenser.

* * * * *